US007111689B2

(12) United States Patent
Wise et al.

(10) Patent No.: US 7,111,689 B2
(45) Date of Patent: Sep. 26, 2006

(54) COILED TUBING INJECTOR DEPLOYMENT ASSEMBLY AND METHOD

(76) Inventors: Leslie Wise, 132 Stradwick Rise SW, Calgary, Alberta (CA) T3H 1G8; Phil Houck, 4956 Norquay Dr. NW, Calgary, Alberta (CA) T2K 2L3; Jerry Provencher, 839 Queensland Dr. SE, Calgary, Alberta (CA) T2J 564

( * ) Notice: Subject to any disclaimer, the term of this patent is extended or adjusted under 35 U.S.C. 154(b) by 277 days.

(21) Appl. No.: 10/841,815

(22) Filed: May 7, 2004

(65) Prior Publication Data

US 2005/0247456 A1 Nov. 10, 2005

(51) Int. Cl.
*E21B 19/22* (2006.01)
*B66C 23/00* (2006.01)

(52) U.S. Cl. ..... 166/384; 166/77.2; 166/85.5; 175/162; 173/28; 173/185; 52/118

(58) Field of Classification Search ..... 166/384, 166/77.2, 85.5, 77.1; 175/162; 173/184, 173/185, 28; 299/75; 52/111, 115, 116, 52/117, 118, 119
See application file for complete search history.

(56) References Cited

U.S. PATENT DOCUMENTS 4,249,600 A * 2/1981 Bailey ..... 166/77.2
6,273,188 B1 * 8/2001 McCafferty et al. ..... 166/77.2
6,973,979 B1 * 12/2005 Carriere et al. ..... 175/203

FOREIGN PATENT DOCUMENTS

JP 04055588 A * 2/1992

OTHER PUBLICATIONS

"Mast Coiled Tubing Unit", Sales Bulletin, BJ Services Company, Jul. 15, 2003.
National Crane website page, Manitowoc Crane Group, Apr. 6, 2004.

* cited by examiner

*Primary Examiner*—David Bagnell
*Assistant Examiner*—Robert E. Fuller
(74) *Attorney, Agent, or Firm*—Howrey LLP

(57) ABSTRACT

An apparatus for transporting an injector assembly, such as an injector and a BOP, for coiled tubing to a wellhead may have a platform, such as a trailer, having a shaft attached thereto by at least one bracket. Pivotally on the bracket may be a boom, which may have telescopic sections, and at least one member, which may have a substantially boomerang shape. The member may be attachable to the bracket by an extendable boom fold actuator, and may be attachable to the boom via an extendable boom operating actuator. By selectively extending and contracting the boom fold actuators and the boom operating actuators, the boom may be selectively positioned between a transport mode, a vertical mode, and an operating mode. In this way, one assembly may be used to transport the coiled tubing and the injector assembly for connection to the wellhead, thus minimizing rig-up or set up time.

35 Claims, 5 Drawing Sheets

COILED TUBING INJECTOR DEPLOYMENT ASSEMBLY AND METHOD

BACKGROUND OF THE INVENTION

1. Field of the Invention

The present invention relates generally to an assembly for use in transporting devices to sites of wellbores. More particularly, this invention relates to a platform such as a trailer for transporting coiled tubing and an injector assembly to a wellhead, and for aiding in the alignment of the injector assembly at a wellhead, for the subsequent injection of coiled tubing into a wellbore.

2. Description of the Related Art

Coiled tubing may better suited for performing various downhole tasks, such as many reservoir stimulation techniques, as opposed to using solid drill string. For example, it is known to attach a downhole tool, such as a straddle packer, to coiled tubing and run the packing device downhole until the desired zone is reached. Once positioned, a well treatment such as a fracing operation or other stimulation operation may be accomplished, e.g. For example, a fluid such a fracing proppant or sand slurry may be forced from surface, through the coiled tubing string and into the zone straddled by the packer.

As an example of an operation using coiled tubing and as shown in FIG. 1, a packer P has been lowered via coiled tubing 10 into a wellbore W to force a fluid into zone Z2, while preventing fluid communication with the zone Z1 above zone Z2.

To inject coiled tubing into the wellbore, an injector assembly having an injector head typically is attached to a wellhead at surface of a wellbore. In a typical coiled tubing operation, coiled tubing is injected downhole through a wellhead by a coiled tubing injector. The injector operates to grab the coiled tubing from the spool and inject the coiled tubing into the wellbore via facing chain drives on the injector.

Generally, a Blow Out Preventor ("BOP") is used as a safety device when performing a downhole operation. The BOP is customarily used in downhole operations to control the well. For instance, if a negative differential pressure between the hydrostatic pressure of the coiled tubing fluid and the formation pressure exists, fluid may tend to escape to surface. Although various configurations and models of BOPs are known, their function is the same: to take over should the primary well control fail. Thus, when running coiled tubing, an injector assembly having a BOP is may be utilized to inject the coiled tubing off the spool and into the wellbore.

Generally, to attach the injector assembly with a BOP to a wellhead, it is known to utilize at least two trucks to align the BOP and the injector with the wellhead. For instance, in the system of FIG. 1, a first truck 1 pulling a trailer 2 is utilized for transporting the coiled tubing spool 20, the BOP 60, and the injector head 50 to the wellhead 1000. The BOP 60 and the injector head 50 may be stored separately on the back of the truck. Or the BOP 60 and injector head 50 may be preassembled and pre-stabbed with the coiled tubing 10 to minimize assembly time at the wellhead 1000. The injector 50 may comprise a gooseneck 55 as shown in FIG. 1 as an aid to align the coiled tubing 10 from the spool 20 into the injector 50.

A second truck 3 may be utilized to transport a second trailer 4 to the site. The second trailer 4 may comprises a crane having a boom 30, which may include a boom with telescopic arms. Such telescoping cranes are known to be commercially available from Furukawa UNIC Cranes from Japan or National Crane Corp. of Shady Grove, Pa., and are known to have a maximum capacity of over 66,000 pounds (29.9 Metric Tons) and a vertical reach of 170 feet (50.9 meters).

Further, when performing a some operations, a third truck or even more trucks may be utilized to accomplish the operation, for example.

The first truck 1 and the second truck 2 are positioned in relatively close proximity to the wellhead 1000 via the truck driver pulling as close as possible to the wellhead 1000. Once both the first truck 1 with trailer 2 and the second truck 3 with trailer 4 are at the wellhead, these trucks are aligned such that the boom 30 on the trailer 4 may be connected to the injector assembly to remove the injector assembly with the injector 50 and the BOP 60 from the first truck 1 and place the BOP 60 on the wellhead 100.

The BOP 60 is manually connected to the end of the arm of the boom crane 30 via a cable 40. Once the BOP 60 is set, the boom crane 30 on the trailer 4 of the second truck 3 may operate to remove the injector head 50 from a rack on the trailer 2 of the first truck 1 to connect the injector head 50 to the BOP 60.

In some cases, the injector 50 is preassembled to the BOP 60, and the injector is pre-stabbed with the coiled tubing 10 during transport. The boom 30 of the crane is attached to the injector assembly via cable 40. The boom crane 30 lifts the injector assembly via a cable 40, and an operator O at surface connects the BOP of the injector assembly to the wellhead 1000. During this connection period, the BOP and the injector assembly may sway from the cable 40 in the wind, a considerable distance above the operator O, the injector assembly weighing over 5000 pounds. It is desirable to provide a more positive connection means such that the injector assembly would be less likely to sway in the wind, which also would improve the safety of the setting operation.

The crane with the boom 30 may have a boom with telescopic arms. Further, the crane may rotate 360 degrees with respect to the bed of the trailer 4. Further, the boom itself may rotate with respect to the plane of surface, from zero degrees (i.e. horizontal) to ninety degrees (i.e. perpendicular) to the trailer.

Once the BOP 60 and injector 50 are attached to the wellhead 100, the coiled tubing 10 is injected from the spool 20 into the wellbore 100. The underground operation, such a running a straddle packer P and performing a well treatment as described above, may be performed.

Various factors may further complicate the alignment of the injector assembly with the wellhead 1000. As stated above, the BOP 60 and the injector 50 may hang or "dangle" from the boom 30 of the crane via the cable 40. Further complicating the procedure is the fact that each the BOP 60 and the injector 50 may weigh in excess of 5000 pounds, with the injector assembly hanging from the cable over thirty feet in the air, the alignment with the wellhead may be difficult. Thus, it is desired that an assembly with improved safety and security for performing the setting operation be provided. I.e. with these injectors and BOPs weighing over 5000 pounds, extending over thirty feet m the air, it is desirable to have control of the movement of the injector to improve the safety of the operation.

Further, in these prior art system, the two drivers for the first truck 1 and second truck 3 attempt to align the trailers 2 and 4 respectively proximate the wellhead 1000. Depending on the drivers' abilities, this alignment operation may prove less than ideal, and may include trial an error, thus increasing the rig up or setting time.

Further, in many some instances the wellhead is not perpendicular with surface. In others, the surface itself is not perfectly horizontal. Further, wind may act to sway the injector assembly as described above. These conditions, inter alia, may cause complications in setting the injector at the wellhead, which, in turn, may increase the rig-up time.

Similarly, when it is desired to remove the coiled tubing from the wellbore, the crane on the second truck may be used to remove the injector assembly with the BOP 60 from the wellhead 1000 via a cable 40. The injector 50 with the BOP 60 may be stored on trailer 2 of the first truck 1, in a dissembled or pre-stabbed/pre-assembled fashion as described above.

It would be advantageous to provide a system, which more positively controlled the movement of the injector assembly for alignment with the wellhead.

Other systems have been developed in an attempt to reduce the amount of operator intervention in the setting of the injector assembly on the wellhead 1000. For example, it is known to utilize a mast crane system for setting up a wellbore intervention. Such a system is the Mast Coiled Tubing Unit, known to be utilized by BJ Services Company, of Houston, Tex. With a mast unit, a self-erecting mast is brought to the wellhead by one truck. The vertical supports of the mast are positioned over the wellhead by properly positioning the trailer on the first truck with respect to the wellhead. Once in the desired location, the vertical supports contact the surface and the mast elevates the injector from eight to forty-eight feet above surface. The mast is attached to a trailer and is erected at the wellbore. Such a mast unit structurally supports the injector. As such, no crane-supported overhead load exists. Thus, fewer overhead lifts are required, as the BOPs are transported on the unit and hydraulically lifted into place.

With a mast unit, a miniature drilling mast is attached to the back of a trailer. The mast is attached in such a way that it may move vertically with respect to the trailer. Some mast units provide little adjustment with respect to the location near the wellhead. Thus, the truck must be driven relatively close to the wellhead for proper alignment. The mast unit is comprised of two vertical uprights with the injector traveling vertically within these uprights. These uprights of the mast are designed to be folded back onto the trailer, and may be placed vertically when it is desired to place the injector on the wellhead.

In some mast systems, alignment with the wellhead is provided by driving the truck around to properly position the mast with respect to the wellhead. Further, two trucks are typically utilized with the mast systems; one for the mast, and one for the coiled tubing and injector assembly. In some mast units, the injector and the BOP are affixed to the mast assembly during transportation and operation. In some mast units, the tubing reels are provided on the same trailer. Regardless, alignment may prove problematic with some of these mast units.

Thus, it is desirable to provide an apparatus for transporting an injector assembly, which may include a coiled tubing injector and a BOP, to a wellhead, and to facilitate the placement of the injector assembly on the wellhead. It is desirable that such an apparatus be quickly and positively aligned with the wellhead. It is desirable that such a system positively provides contact between the injection assembly and the wellhead such that the assembly does not dangle overhead of operators from a cable. It is further desirable that the apparatus allow the BOP and injector to be pre-stabbed with coiled tubing during transport to minimize rig-up time at the site. It is desirable to minimize the equipment and manpower required at the wellbore. Thus, it is desirable that the BOP be preassembled with the injector head to minimize rigging or set up time. It if further desirable to remove some of the human interaction, to reduce the number of operators and equipment at the wellhead, and to improve the placement accuracy of the injector assembly.

Thus, it would be desirable to provide a coiled tubing injector head and a BOP attached to a boom that can extend the assembly from a trailer to a wellhead for proper alignment. Such an assembly may decrease the rig-up and rig-down times of prior art system.

The present invention is directed to overcoming, or at least reducing the

SUMMARY OF THE INVENTION

The invention relates to work performed with coiled tubing, the coiled tubing being injected into the wellbore by an injector of an injector assembly. The injector may be fixedly connected to a BOP stack, and may be pivotally attached to a telescopic boom, which may extend the injector assembly from the trailer to the wellhead. In some embodiments, the boom includes a 180 degree pivot, a 360 degree (and preferably 90 degree) boom swing, and may be hydraulically powered. In some embodiments, the injector assembly may be removed from the boom via a quick disconnect, and used with a picker. In some embodiments, the coiled tubing is continuously stabbed into the injector and the BOP during transport to the wellhead.

In some embodiments, a coiled tubing injector deployment trailer for transporting coiled tubing and an injector assembly to a wellhead is provided having a shaft, a plurality of brackets to support the shaft on the trailer, a boom pivotally associated with the shaft between the brackets, and a plurality of members pivotally associated with the shaft, each member having boom fold actuator with a contracted and extended position, each boom fold actuator adapted to attach the member to the trailer. In some embodiments, the substantially one end of each member is connected to the boom fold actuator by a first connecting rod, and substantially the other end of each member is connected to the boom operating actuator by a second connecting rod.

In some aspects, each member may be attachable to the boom by a boom operating actuator having a contracted and extended position, wherein the boom is operably associated with the injector assembly to position the injector assembly on the wellhead for injecting the coiled tubing. The boom on the trailer may define a transport mode when the boom fold actuator is substantially in the contracted position and the boom operating actuating is substantially in the extended position, the trailer adapted to transport the injector, boom and coiled tubing while in the transport mode. In this way, one assembly may be utilized to transport and set the injector assembly on the wellhead.

In other configurations, the boom on the trailer may be selectively moved from the transport mode to a vertical position, to an operating position, by selectively expanding or contracting the boom fold actuators and the boom operating actuators. In some configurations, the boom is also provided on a turret to provide 90-degree or even 360-degree rotations; in others, the boom is comprised of telescoping sections.

A platform for transporting a device to a site on surface is described having a shaft; a plurality of brackets to support the shaft on the platform; a boom pivotally associated with the shaft; and at least one member pivotally associated with the shaft, each member having boom fold actuator with a contracted and extended position, each boom fold actuator adapted to attach the member to the platform, each member being attachable to the boom by a boom operating actuator having a contracted and extended position, wherein the boom is operably associated with the device to position the device at a predetermined location at surface. The platform may comprise a trailer in some embodiments. A coiled tubing injector deployment arm is also described having a trailer for transporting to a wellhead; a shaft; a plurality of brackets to support the shaft on the trailer; a boom pivotally associated with the shaft between the brackets; and a plurality of members pivotally associated with the shaft, each member having boom fold actuator with a contracted and extended position, each boom fold actuator adapted to attach the member to the trailer, each member being attachable to the boom by a boom operating actuator having a contracted and extended position, wherein the boom is operably associated with the injector assembly to position the injector assembly on the wellhead for injecting the coiled tubing.

A method of aligning a coiled tubing injector assembly with a wellhead is provided comprising the steps of (1) providing a trailer in a transport mode having a shaft, a plurality of brackets to support the shaft on the trailer, a boom pivotally associated with the shaft between the brackets, the boom having telescoping sections and a plurality of members pivotally associated with the shaft, each member having boom fold actuator with a contracted and extended position, each boom fold actuator adapted to attach the member to the trailer, each member being attachable to the boom by a boom operating actuator having a contracted and extended position; (2) transporting the trailer to a location substantially proximate the wellhead; (3) actuating the boom fold actuator to rotate the boom into a vertical position; and (4) contracting the boom operating actuator, rotating the turret, and/or extending the telescoping sections of the boom until the injector assembly is properly aligned with the wellhead.

Additional objects, features and advantages will be apparent in the additional written description that follows.

BRIEF DESCRIPTION OF THE DRAWINGS

The following figures form part of the present specification and are included to further demonstrate certain aspects of the present invention. The invention may be better understood by reference to one or more of these figures in combination with the detailed description of the specific embodiments presented herein.

Figure 1:
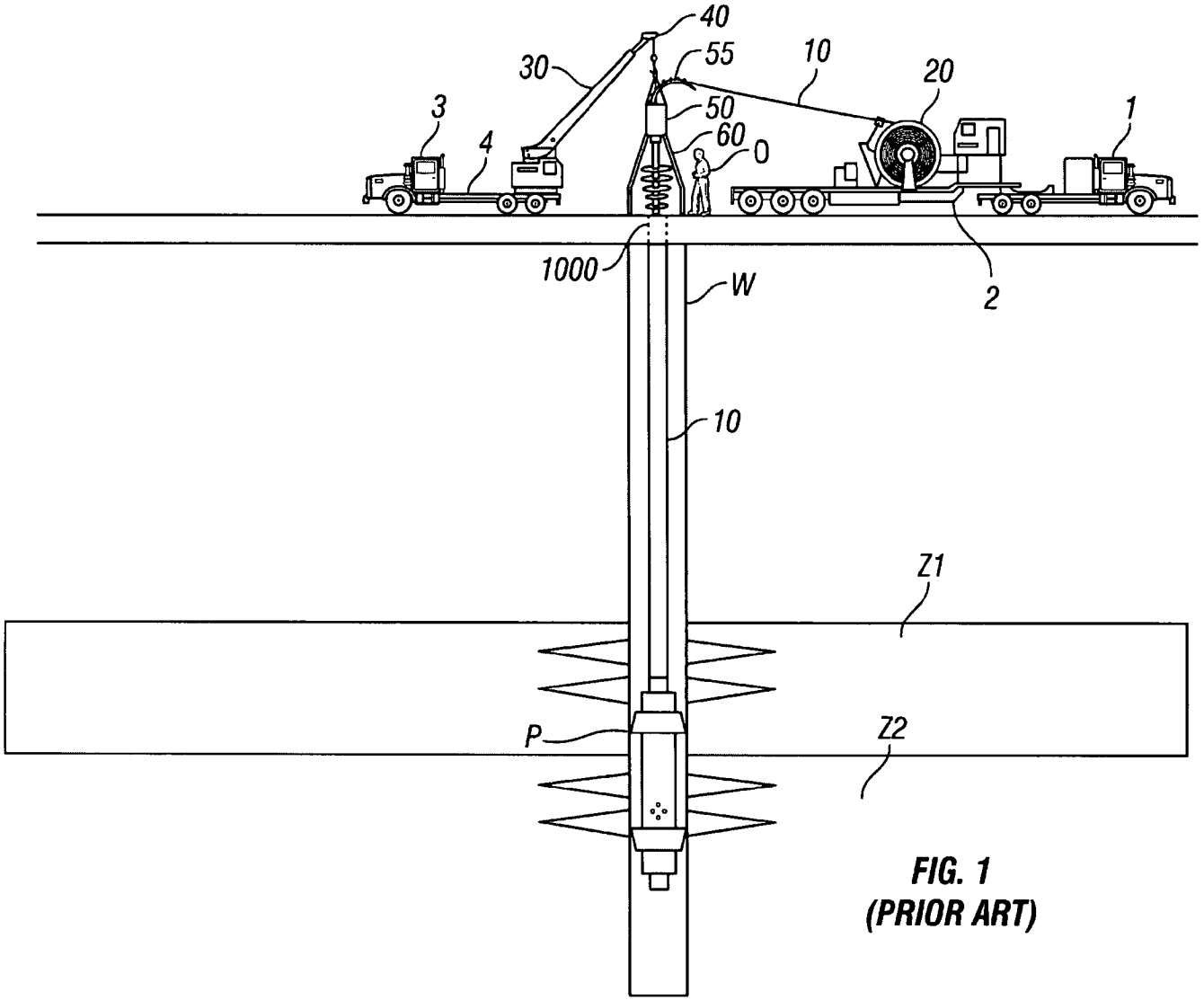
FIG. 1 (PRIOR ART)
FIG. 1 shows a prior art system for setting the injector and BOP at the wellhead 1000.

While the invention is susceptible to various modifications an alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in transporting an injector assembly for alignment with a wellhead. In the interest of clarity, not all features of an actual implementation are described in this specification. It will of course be appreciated that in the development of any such actual embodiment, numerous implementation specific decisions must be made to achieve the developers' specific goals which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments of the invention will become apparent from consideration of the following description and drawings.

The following examples are included to demonstrate preferred embodiments of the invention. It should be appreciated by those of skill in the art that the techniques disclosed in the examples which follow represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Embodiments of the invention will now be described with reference to the accompanying figures.

Figure 2A:
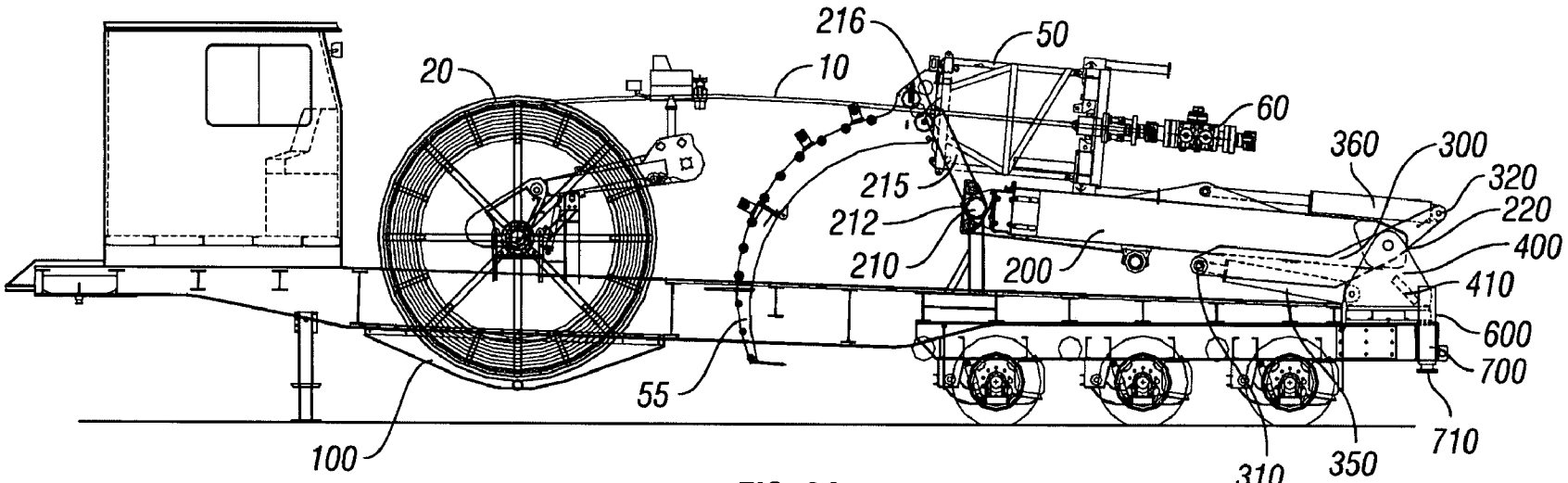
FIG. 2A shows a side view of an embodiment of the present disclosure in a transport mode, with a boom in a down or transport position.
Figure 2B:
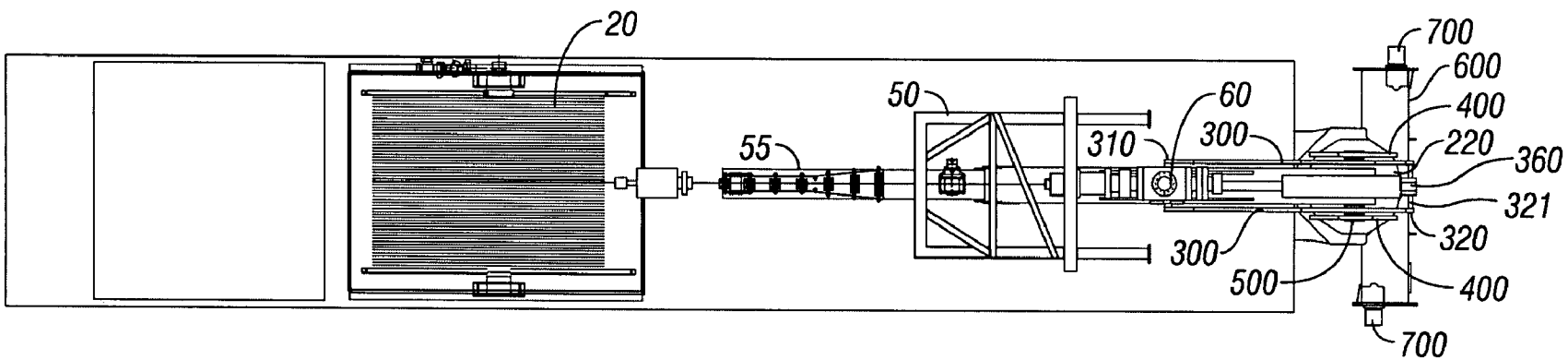
FIG. 2B shows the top view of the embodiment of FIG. 2A.

Referring to FIGS. 2A and 2B, one embodiment of the present invention is shown while in the transport mode. A spool 20 of coiled tubing 10 is shown on a platform, such as trailer 100. A coiled tubing injector assembly is shown as an injector 50 having a gooseneck 55 and a Blow Out Preventor ("BOP") 60 in this embodiment. As shown, the coiled tubing 10 is stabbed into the injector 50 and BOP 60.

The injector assembly is shown attached to an end 210 of boom 200. The boom 200, as will be described more fully hereinafter, may be comprised of telescopic sections 250. As shown, the injector assembly is pivotally mounted to one end 210 of the boom 200 by a pivotal attachment member 215. The pivotal attachment member 215 may comprise one end 212 pivotally attached to the end 210 of the boom, and one end 216 pivotally attached to the injector 50 of the injector assembly. The end 216 of the pivotal attachment member 215 may further comprise a quick disconnect, as would be known to one of ordinary skill in the art having the benefit of this disclosure. It should be mentioned that in other embodiments, when the injector assembly is detached, the boom assembly may be used as a picker. In some embodiments, a winch (not shown) may be permanently attached to the boom 200. Thus, the winch is adapted to be used with or with the injector assembly attached.

The boom 200 may also have an end 220 pivotally mounted to a support shaft 500. Support shaft 500 may extend between two support brackets 400. Each of the support brackets 400 may be attached directly to the platform, such as trailer 100 in some embodiments. Alternatively, the support brackets 400 may be attached to turret 600 described hereinafter.

As shown, each of the support brackets 400 may comprise a generally-triangular shape, with the support shaft 500 extending through the apex of each triangular support bracket. However, the support brackets 400 need not comprise a triangular shape. Further, the invention described and claimed herein is not limited to two support brackets; rather, one or more than two support brackets could be utilized. Further, the support brackets 400 may comprise a mechanical stop 410 as described hereinafter.

As shown in FIG. 2B, the support shaft 500 extends between the two support brackets 400 in this embodiment. Boom 200 may have an end 220 pivotally mounted to the support shaft 500.

As shown in FIG. 2B, a member 300 is located on either side of the boom 200, and between the boom 200 and each of the brackets 400. The members 300 are attachable to the shaft 500 as shown in FIG. 2A, such that each member 300 may be rotated about shaft 500. In this embodiment, the members 300 are shown to have a generally boomerang or dog-leg shape, i.e. two relatively straight portions or segments jointed at an obtuse angle, e.g. approximately 150 degrees in this embodiment. However, such an arrangement is not required. Further, although two members 300 are shown, the invention is not so limited as only one member or more than two members 300 could be utilized as would be apparent to one of ordinary skill in the art having the benefit of this disclosure.

Functionally associated with each member 300 are two actuators. In the embodiment shown in FIG. 2A, the boom fold actuator 350 is pivotally attached at one end 310 of each member 300, at a point 310 located substantially on the end of member 300, via first connecting rod 311, while boom operating actuator 360 is pivotally attached, substantially at the another end 320 of the member 300, via a second connecting rod 321. It should be mentioned that in other embodiments, each member 300 may be directly attached to actuators on each end: a boom fold actuator 350 directly pivotally attached substantially at one end 310 of member 300 and boom operating actuator 360 directly pivotally attached to the other end 320 of member 300. Thus, if two members are utilized, a total of four actuators may be utilized. Other configurations, which provide the same functionally as described herein may be utilized, as would be realized by one of ordinary skill in the art having the benefit of this disclosure.

In this embodiment, one end 351 of the boom fold actuator 350 is pivotally connectable substantially at one end 310 of member 300 via a first connecting rod 311. The other end 352 of boom fold actuator 350 is shown pivotally connected to the support bracket 400. In the embodiment shown, each of the boom fold actuators 350 is moveably attached to each of the members 300 at a location below shaft 500.

In this embodiment, one end 362 of each of the boom operating actuators 360 is pivotally attached substantially at one end 320 of each of the members 300 via the second connecting rod 321. The other end 361 of the boom operating actuators 360 may be pivotally attachable to the boom 200 as shown in FIG. 2A.

Although the boom fold actuators 350 and boom operating actuators 360 are located substantially on an end of members 300, such a configuration is not a requirement, as other locations of attachment along the member 300 which allow the member to operate as described herein would be acceptable.

Each of the boom operating actuators 360 and the boom fold actuators 350 have an adjustable length: each has a contracted position and may selectively expand to an extended position in operation.

In this embodiment, the boom operating actuators 360 and the boom fold actuators 350 may comprise cylinders, such as hydraulic cylinders. However, the invention herein disclosed and claimed is not so limited. For example, pneumatic cylinders, or motor-driven threaded shafts may be utilized, as could any other driving means known to one of ordinary skill in the art. In short, any actuator known to one of skill in the art having the benefit of this disclosure could be utilized.

FIG. 2B shows a top view in which the brackets 400 are located on the outer position of the shaft 500, substantially adjacent the members 300 on the shaft 500, with the boom 200 located approximately on the center of the shaft 500.

FIGS. 2A and 2B show an embodiment of the invention in the transport mode. As such, the components of the invention are located substantially over the platform, such as trailer 100, and are not extended. Thus, a truck (not shown) may pull the trailer 100 to the site of the wellhead, into which the coiled tubing 10 is to be inserted. With the components of the invention in a withdrawn, non-extended configuration, the isolation deployment arm may be transported more securely to the site.

It should be noted that in the transport mode, the configuration of the actuators is as follows: each of the boom operating actuator 360 is each in a substantially extended position, and each of the boom fold actuators 350 is in a substantially contracted position.

Figure 3A:
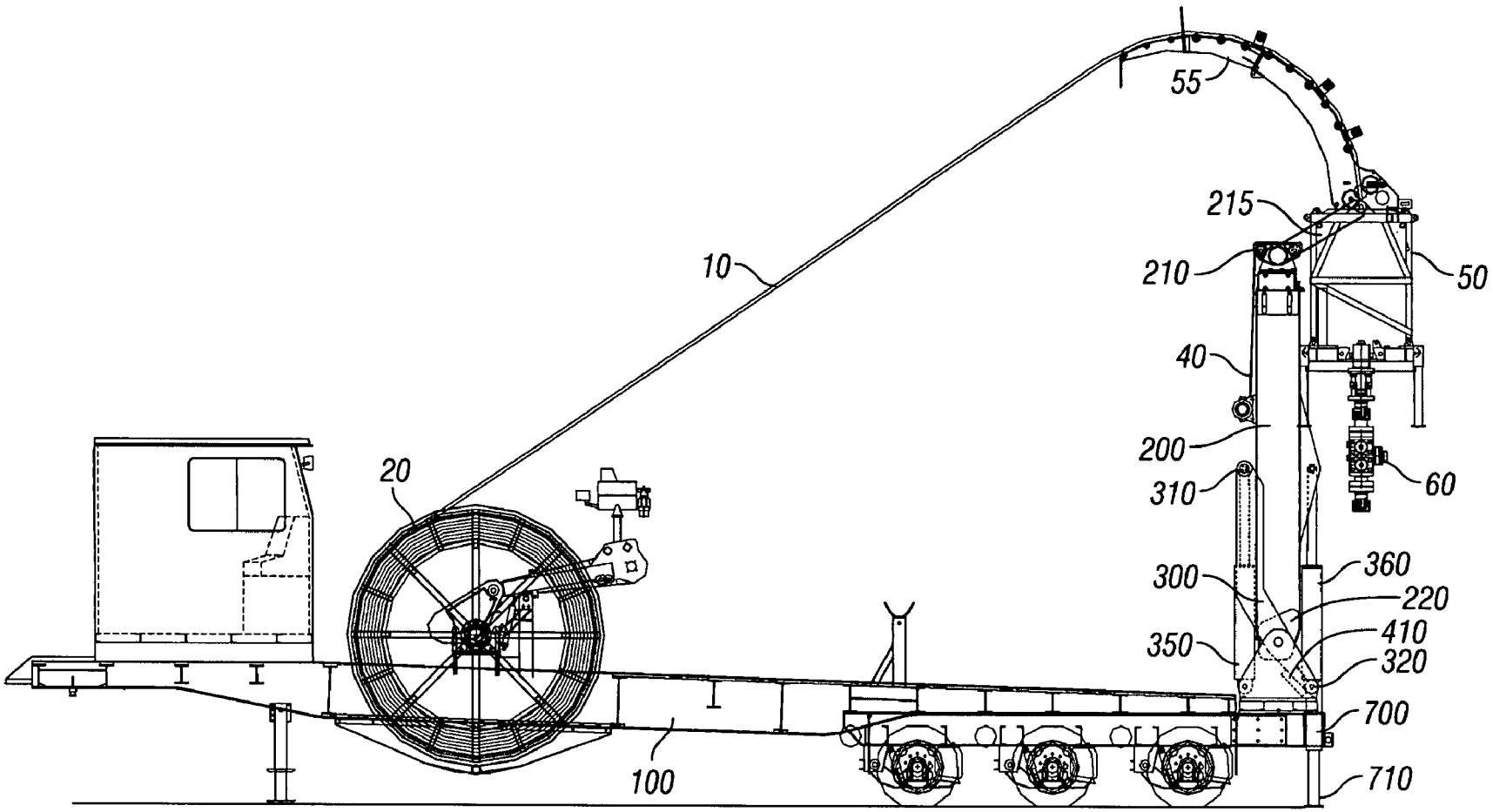
FIG. 3A shows a side view of an embodiment of the present disclosure with a boom in an upright or vertical position.

FIG. 3A shows a side view of an embodiment of the present invention in which the boom 200 has been elevated to an upright or vertical position. In this configuration, each of the boom fold actuators 350 is in a substantially extended position, as is each of the boom operation actuators 360. Given the configuration of the members 300, the extension of the boom fold actuators 350 causes the boom 200 to rotate about shaft 500 to an upright or vertical position. The rotation from FIG. 2A to FIG. 3A is clockwise.

Because of the pivotal connections on each end of the pivotal attachment member 215, the injector assembly also rotates to the position shown in FIG. 3A, i.e. such that the injector 50 and the BOP 60 are vertically aligned with the boom 200. The gooseneck 55 operates to guide the coiled tubing from the spool into the injector assembly such that an acute angle is not formed thus protecting the coiled tubing from damage.

As shown in FIG. 3A, an end 320 of the member 300 is in contact with the mechanical stop 410 on bracket 400. The mechanical stop 410 thus limits the extension of the boom fold cylinder 350 and operates to prevent the boom fold cylinder 350 from further rotating the boom 200 clockwise about the shaft 500. Further, the mechanical stop 410 may prevent boom loading from being transmitted to the boom fold actuator 350.

Once the boom 200 is in a vertical position, then boom 200 is capable of extending, via the telescopic sections 250 of boom 200. In some embodiments, the boom 200 is not allowed to extend telescopically until the boom 200 is in the vertical position (i.e. not in the transport mode), by virtue of control mechanisms known to one of ordinary skill in the art. For instance, power is not provided to the drive the telescopic sections outwardly with respect to the shaft 500 unless at least one member 300 is in contact with a mechanical stop 410 in some embodiments.

The telescopic sections 250 of the boom 200 will function via, but limited to, hydraulic control devices. The telescopic section 250 will be propagated with, but not limited to, hydraulic cylinders and cable mechanisms as would be known to one of ordinary skill in the art having the benefit of this disclosure.

Figure 3B:
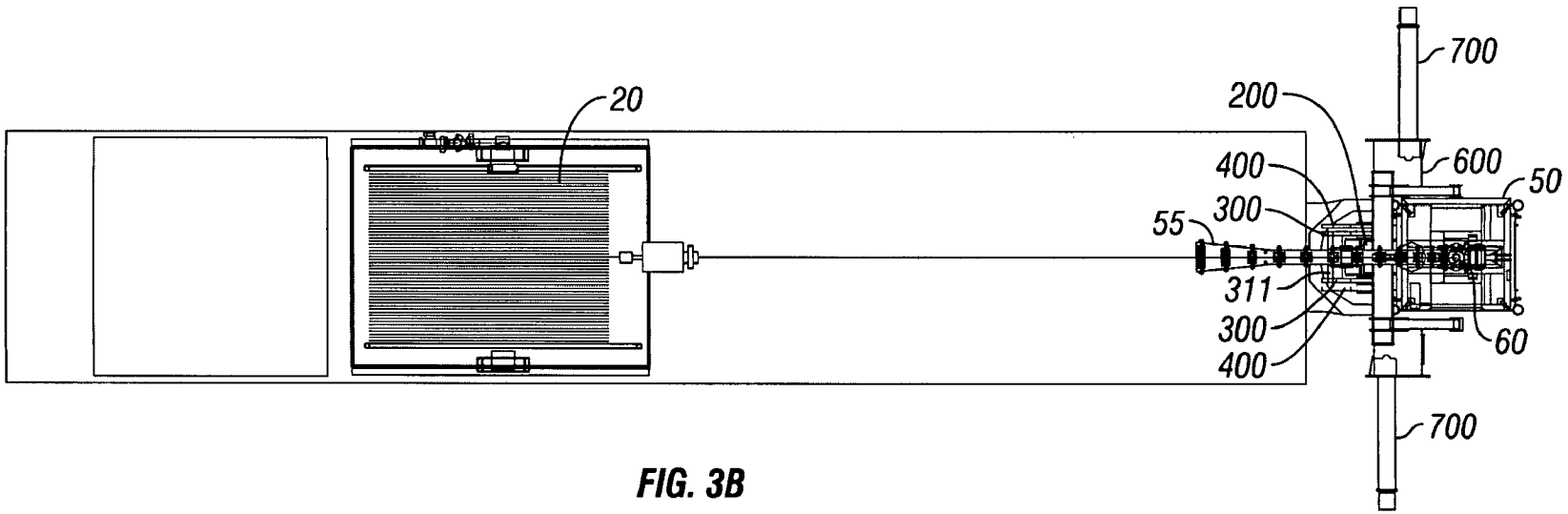
FIG. 3B shows the top view of the embodiment of FIG. 3A.

FIG. 3B is a top view of the embodiment of FIG. 3A. Also shown in FIG. 3B are outriggers 700. As shown in FIGS. 3A and 3B, the outriggers 700 are extended across the end of the trailer 100. Legs 710 are extended downwardly to contact the surface to stabilize the vertical boom 200, inter alia.

It should be noted that with the boom 200 in a vertical or upright position, the configuration of the actuators is as follows: each of the boom operating actuator 360 is each in a substantially extended position, and each of the boom fold actuators 350 is also in a substantially extended position.

Figure 4A:
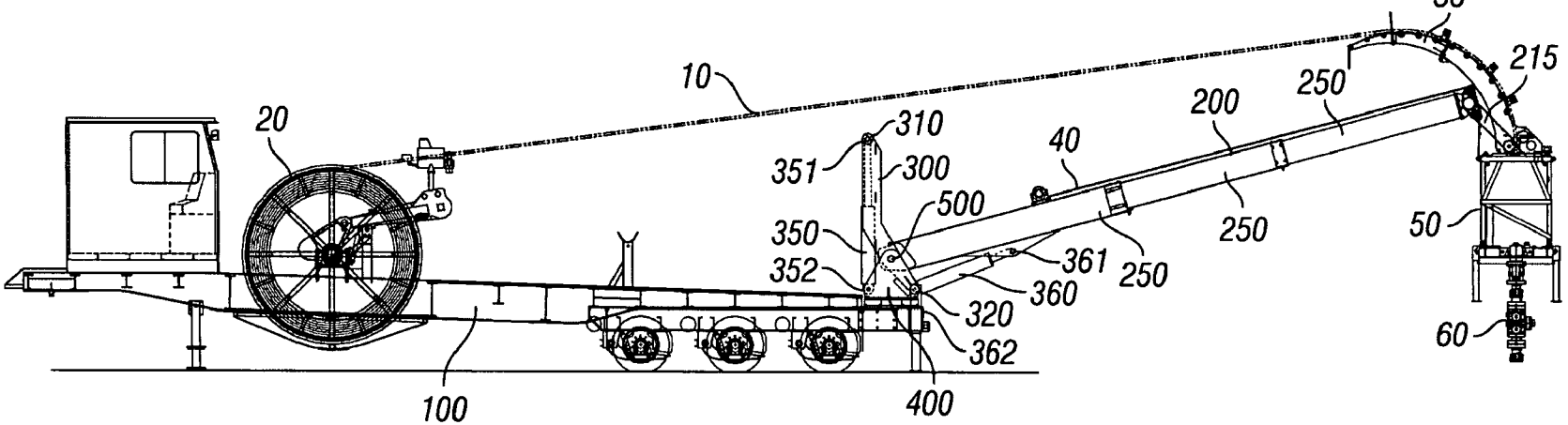
FIG. 4A shows a side view of an embodiment of the present disclosure with a boom in an operating position.
Figure 4B:
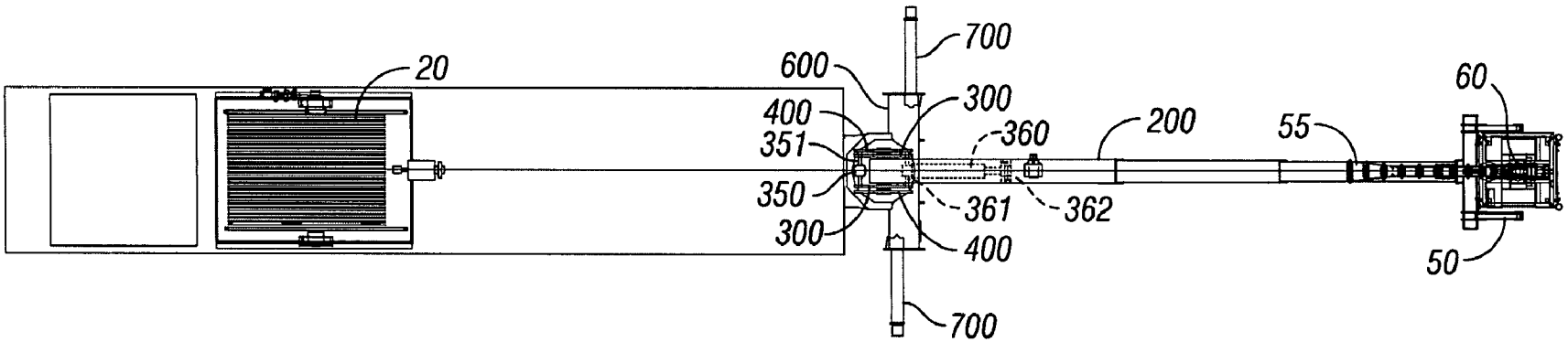
FIG. 4B shows the top view of the embodiment of FIG. 4A.

FIG. 4A shows an embodiment of the present invention in which the boom 200 has been extended to the operation mode; and FIG. 4B shows a top view of the embodiment of FIG. 4B. In the operation mode, the boom fold actuator 350 is in a substantially-extended position. By contracting the boom operating actuator 360, the angle the boom 200 makes with a horizontal plane is changed: the more the boom operating actuator 360 is contracted, the smaller the angle.

In operation, the assembly including a platform, such as a trailer 100 is transported to the wellhead via a truck (not shown). When being transported, the boom 200 is in the transport mode with the boom 200 folded back onto the trailer 100, as shown in FIG. 2A.

Once the trailer 100 reaches the desired location proximate the wellhead 1000, the boom 200 may be extended. As shown in FIGS. 2A and 2B, prior to the extension of the boom 200, an outrigger 700 may be extended from the boom end of the trailer 100 to provide additional support to stabilize the boom 200 in operation. As shown, the outrigger 700 comprises two legs 710 extended toward and contacting surface. As shown in FIG. 2A, the boom fold actuator 350 is in a contracted state, while the boom operating actuator 360 is in an extended position.

To extend the boom 200 from the transport mode to the upright position in this embodiment, boom fold actuator 350 is actuated such that its length (i.e. the distance between the ends of the boom fold actuator 350) increases. That is, to raise the boom 200 to the vertical position, the boom fold actuator 350 is actuated from a contracted position to an extended position. In the embodiment of FIG. 2A, the actuation of the boom fold actuator 350 causes the boom 200 to rotate about the end 220 and about shaft 500. Thus, the boom 200 moves in a clockwise fashion to the vertical position as shown in FIG. 3A. Of course, the injector assembly, including the injector 50 and the BOP 60 in this embodiment, also moves to the position as shown in FIG. 3A, by virtue of the pivotal connection to the end 210 of the boom 200. In this configuration, the coiled tubing 10 contacts the gooseneck 55 as shown.

Once the boom 200 is in the upright or vertical position as shown in FIG. 3A, the members 300 are each adapted to contact a mechanical stop 410 on the support bracket 400. Of course, the mechanical stop 410 may be located at any location along the bracket 400 so long as the stop prevents further rotation of the boom 200 about the shaft 500. Further, the stop 410 may further be located on the members 300 which could contact a slot within the support bracket 400. In this way, the mechanical stop prevents the accidental extension of the boom 200, thus providing an additional margin of safety during the operation of the boom 200.

Finally, to move from the configuration from FIG. 3A to FIG. 4A, the boom operating actuator 360 is contracted. The contraction of the boom operating actuator 360 forces the boom to move clockwise to the position as shown in FIG. 4A. To place the boom in the operating position of FIG. 4A, the boom operating actuator 360 is contracted, the boom fold actuator 350 remaining in an extended position. As shown in FIG. 4A, the boom 200 may extend via the extension of telescopic sections 250 of the boom 200. The extension of the telescopic sections 250 of the boom 200 is similar to that of the prior art.

The injector assembly moves concomitantly, as the injector 50 is pivotally attached to the end 210 of the boom 200 as described above. In this way, the injector assembly including the injector 50 and the BOP 60 in this embodiment, may be positively placed with respect to the wellhead 1000; i.e. the injector 50 and BOP 60 do not "dangle" from a cable swaying in the wind above the wellhead.

The boom 200 described above may be directly, fixedly attached to the trailer 100, or as stated above, the brackets 400 supporting the shaft 500 to which the boom 200 is pivotally attached may be rotationally connected to the trailer 100 via a turret 600. The turret 600 may be rotated on trailer 100 in any manner known to one of skill in the art, such as by gears driven by a motor. The turret 600 may be pivotally attached to the trailer 100 such that the boom 200 may rotate in the horizontal plane, preferably a total of 90 degrees. Thus, the turret 600 may be adapted to limit the rotation a given amount, such as plus or minus 45 degrees from a longitudinal axis of the trailer 100. Alternatively, in some embodiments, the turret 600 may be adapted to rotate a full 360 degrees provided no other components (e.g. the coiled tubing from the spool 20) interfere with the rotation.

Further, to position the injector assembly on the wellhead, the operator is provided with multiple degrees of freedom. Thus, the alignment of the truck and trailer with respect to the wellhead less critical than before, while rig-up time is minimized. The turret 600 provides rotation in a horizontal plane, preferably but not limited to 90 degrees. The telescopic sections 250 of the boom 200 provide both vertical and horizontal positioning. The rotation of the boom 200 about the shaft 500 as controlled by the boom operation actuator 360 provides 180 degree boom pivot. Further, the pivotal attachment member 215 provides a positive connection between the boom 200 and the injector 50 further the injector assembly does not sway overhead unrestrained further facilitating the placement of the injector assembly on the wellhead. That is, the injector assembly (injector 50 and BOP 60 in this embodiment) does not dangle from a cable or sway in the wind above the wellhead. In this way, rig-up time is minimizes and safety of the operation is increased.

In this way, alignment of the coiled tubing injector 50 and BOP 60 with the wellhead 1000 is facilitated. Further, only one truck is required to transport only one trailer to the wellhead.

In other embodiments, the coiled tubing injector assembly may be disconnected via a quick disconnect. In some embodiments, as described above, a winch is permanently attached to the boom 200. The winch is adapted for use with or without the injection assembly attached. Thus, a different apparatus, such as a picker or a winch, may be on the end of the boom 200 via the pivotal attachment member. Thus, the disclosed assembly provides additional versatility to prior art systems.

Once the injector assembly is attached to the wellhead, the injector assembly may begin to inject the coiled tubing 10 from the spool 20 into the wellbore W to perform any desired operation with coiled tubing.

When it is desired to remove the injector assembly from the wellhead, the coiled tubing is retraced and re-spooled about spool 20. The BOP 60 is disconnected from the wellbore. The boom operating actuator 360 is moved from a contracted position of FIG. 4A to an extended position of FIG. 3A, forcing the boom 200 to rotated counterclockwise. Concomitantly, the telescoping sections 250 are retracted into the boom 200 as shown in FIG. 3A. Once in the vertical position, the boom is lowered into the transport mode of FIG. 2A by the contraction of the boom fold actuator 350. Once in the transport mode, the platform, such as the trailer 100 may be transported to a new location.

While the structures and methods of this invention have been described in terms of preferred embodiments, it will be apparent to those of skill in the art that variations may be applied to the process described herein without departing from the concept, spirit and scope of the invention. All such similar substitutes and modifications apparent to those skilled in the art are deemed to be within the spirit, scope and concept of the invention as it is set out in the following claims.

The following table lists the description and the numbers as used herein and in the drawings attached hereto.

| Reference Designator | Component |
|---|---|
| 1 | First Truck |
| 2 | Trailer on First Truck |
| 3 | Second Truck |
| 4 | Trailer on Second Truck |
| 10 | Coiled Tubing |
| 20 | Spool for Coiled Tubing |
| 30 | Boom of Crane |
| 40 | Cable |
| 41 | Pulley |
| 50 | Injector |
| 55 | Gooseneck |
| 60 | Blow Out Preventor |
| 70 | Wellhead |
| 100 | Trailer |
| 200 | Boom |
| 210 | End of Boom |
| 212 | End of Pivotal Attachment |
| 215 | Pivotal Attachment Member |
| 216 | End of Pivotal Attachment Member |
| 220 | End of Boom |
| 250 | Telescopic Sections of Boom |
| 300 | Member (boomerang) |
| 310 | One end of Member 300 |
| 311 | First Connecting Rod |
| 320 | Another end of Member 300 |
| 321 | Second Connecting Rod |
| 350 | Boom Fold Actuator |
| 351 | One end of Boom Fold Actuator |
| 352 | Other end of Boom Fold Actuator |
| 360 | Boom Operating Actuator |
| 361 | One end of Boom Operating Actuator |
| 362 | Other end of Boom Operating Actuator |
| 400 | Support Brackets |
| 410 | Stop on Support Bracket |
| 500 | Support Shaft |
| 600 | Turret |
| 700 | Outrigger |
| 710 | Legs of Outrigger |
| 1000 | Wellhead |

-continued

| Reference Designator | Component |
|---|---|
| O | Operator |
| Z1 | Zone 1 |
| Z2 | Zone 2 |
| P | Packer |
| W | Wellbore |

What is claimed is:

1. A coiled tubing injector deployment trailer for transporting coiled tubing and an injector assembly to a wellhead, comprising:

a shaft;

a plurality of brackets to support the shaft on the trailer;

a boom pivotally associated with the shaft between the brackets; and a plurality of members pivotally associated with the shaft, each member functionally associated with at least one boom fold actuator with a contracted and extended position, the boom fold actuator adapted to attach the plurality of members to the trailer, each member being attachable to the boom by at least one boom operating actuator having a contracted and extended position, wherein the boom is operably associated with the injector assembly to position the injector assembly on the wellhead for injecting the coiled tubing.

2. The coiled tubing injector deployment trailer of claim 1 in which each member is connected to the at least one boom fold actuator by a first connecting rod substantially on a first end of each member.

3. The coiled tubing injector deployment trailer of claim 2 in which each member is connected to the boom operating actuator by a second connecting rod substantially on a second end of each member.

4. The coiled tubing injector deployment trailer of claim 3 in which the at least one boom fold actuator comprises one boom fold actuator, and the at least one boom operating actuator comprises one boom operating actuator.

5. The trailer of claim 1 in which the boom on the trailer defines a transport mode when the boom fold actuator is substantially in the contracted position and the boom operating actuating is substantially in the extended position, the trailer adapted to transport the injector, boom and coiled tubing while in the transport mode.

6. The trailer of claim 5 in which the coiled tubing is stabbed into the injector assembly when the trailer is in the transport mode to minimize installation time of the injector on the wellhead.

7. The trailer of claim 5 in which the boom defines an upright position when the boom fold actuator is substantially in the extended position and the boom operating actuator is substantially in the extended position.

8. The trailer of claim 7 in which the plurality of brackets comprise at least one mechanical stop, such that when the boom is in the upright position, at least one of the plurality of members contacts at least one mechanical stop.

9. The trailer of claim 7 in which the boom defines an operating position when the boom fold actuator is substantially in the extended position, boom operating actuator being selectively moveable between the extended and contracted position to aid in the alignment of the injector assembly with the wellhead.

10. The trailer of claim 9 in which at least one of the members contacts at least one mechanical stop on at least one of the brackets before boom operating actuator is selectively moveable between the extended and contracted position.

11. The trailer of claim 10 in which the boom further comprises a plurality of telescopic arms operable to change the length of the boom to further aid in the alignment of the injector assembly with the wellhead.

12. The trailer of claim 11 in which the telescopic arms operate to change the length of the boom to raise and lower the injector assembly when the trailer is in the upright position.

13. The trailer of claim 12 in which each of the plurality of brackets supporting the shaft for the boom and members, is rotatably connected to the trailer by a turret such that the boom is rotatable in a horizontal plane to aid in the alignment of the injector assembly with the wellhead to aid in the alignment of the injector assembly with the wellhead.

14. The trailer of claim 13 in which the boom is rotatably 360 degrees in the horizontal plane.

15. The trailer of claim 13 in which the boom is rotatable in the horizontal plane twenty degrees with respect to an axis of the trailer.

16. The trailer of claim 1 in which the injector assembly comprises an injector and a blow out preventor.

17. The trailer of claim 16 wherein the injector assembly further comprises a gooseneck.

18. The trailer of claim 1 wherein each of the plurality of brackets is comprised of a substantially triangular shape with the pivot point substantially at an apex, the shaft received in each bracket at the pivot point.

19. The trailer of claim 1 in which the plurality of boom operating actuators and the plurality of boom fold actuators each comprise a cylinder.

20. The trailer of claim 19 in which the plurality of boom operating actuators and the plurality of boom fold actuators comprise hydraulic cylinders.

21. The trailer of claim 20 in which at least one of the members is hydraulically locked against a mechanical stop on at least one of the brackets when the boom is in the upright position.

22. The trailer of claim 1 in which the injector assembly is pivotally attached to the boom via a pivotal attachment member, the pivotal attachment member having one end being pivotally attached to the end of the boom, the pivotal attachment member having another end pivotally attached to the injector assembly, the pivotal attachment member aiding in the positive alignment of the injector assembly with the wellhead.

23. The trailer of claim 22 in which the injector assembly is adapted to be selectively detachable to the boom by a quick disconnect connection.

24. The trailer of claim 1 in which the plurality of members each comprise an angled member of two substantially-straight segments meeting at an angle.

25. The trailer of claim 24 in which the angle is approximately 150 degrees.

26. The trailer of claim 24 in which the member is substantially boomerang-shaped.

27. The trailer of claim 1 further comprising an outrigger substantially on an end of the trailer.

28. The trailer of claim 27 in which the outrigger has a plurality of legs adapted to extend from the outrigger to surface to stabilize the trailer as the boom moves.

29. A platform for transporting a device to a site on surface, comprising:

a shaft;

a plurality of brackets to support the shaft on the platform;

a boom pivotally associated with the shaft between the brackets; and at least one member pivotally associated with the shaft, each member having a boom fold actuator with a contracted and extended position, each boom fold actuator adapted to attach the member to the platform, each member being attachable to the boom by a boom operating actuator having a contracted and extended position, wherein the boom is operably associated with the device to position the device at a predetermined location at surface.

30. The platform of claim 29 in which the boom on the platform defines a transport mode when the boom fold actuator is substantially in the contracted position and the boom operating actuator is substantially in the extended position, the platform adapted to transport the device while in the transport mode.

31. The platform of claim 29 wherein the device is an injector assembly and the site is a wellhead, and the platform is operable to aid in the alignment of the device with the wellhead.

32. The platform of claim 29 wherein the device is an isolation assembly, the boom having a winch attached thereto.

33. A coiled tubing injector deployment arm, comprising:

a trailer for transporting to a wellhead;

a shaft;

a plurality of brackets to support the shaft on the trailer;

a boom pivotally associated with the shaft between the brackets; and a plurality of members pivotally associated with the shaft, each member having boom fold actuator with a contracted and extended position, each boom fold actuator adapted to attach the member to the trailer, each member being attachable to the boom by a boom operating actuator having a contracted and extended position, wherein the boom is operably associated with the injector assembly to position the injector assembly on the wellhead for injecting the coiled tubing.

34. A method of aligning a coiled tubing injector assembly with a wellhead comprising:

providing a trailer in a transport mode having a a shaft, a plurality of brackets to support the shaft on the trailer, a boom pivotally associated with the shaft between the brackets, the boom having telescoping arms and a plurality of members pivotally associated with the shaft, each member having boom fold actuator with a contracted and extended position, each boom fold actuator adapted to attach the member to the trailer, each member being attachable to the boom by a boom operating actuator having a contracted and extended position;

transporting the trailer to a location substantially proximate the wellhead;

actuating the boom fold actuator to rotate the boom into a vertical position; and contracting the boom operating actuator, rotating the turret, and/or extending the telescoping arms of the boom until the injector assembly is properly aligned with the wellhead.

35. The method of claim 34 further comprising extending the legs of an outrigger from an end of the trailer to surface to stabilize the boom.

* * * * *

UNITED STATES PATENT AND TRADEMARK OFFICE

CERTIFICATE OF CORRECTION

PATENT NO. : 7,111,689 B2
APPLICATION NO. : 10/841815
DATED : September 26, 2006
INVENTOR(S) : Leslie Wise, Phil Houck and Jerry Provencher It is certified that error appears in the above-identified patent and that said Letters Patent is hereby corrected as shown below:

On the title page; item [73] Assignee should read,

--Assignee: BJ Services Company of Houston, TX (US)--

In claim 14, line 18, please change "rotatably" to --rotatable--.

Signed and Sealed this

Twenty-sixth Day of June, 2007

JON W. DUDAS
*Director of the United States Patent and Trademark Office*